United States Patent [19]

O'Neill et al.

[11] Patent Number: 4,756,823

[45] Date of Patent: Jul. 12, 1988

[54] PARTICLE SEPARATION

[75] Inventors: Derek O'Neill, Cleveland; James A. Robson, North Yorkshire; Leonard K. Pugh, Cleveland, all of England

[73] Assignee: Carbo Fleet Chemical Co., Ltd., Cleveland, England

[21] Appl. No.: 836,253

[22] Filed: Mar. 5, 1986

[30] Foreign Application Priority Data

Mar. 8, 1985 [GB] United Kingdom ..... 8506077
Mar. 13, 1985 [GB] United Kingdom ..... 8506540

[51] Int. Cl.[4] ..... B03D 1/02

[52] U.S. Cl. ..... 209/166; 209/5; 252/61

[58] Field of Search ..... 209/5, 166, 167; 252/61

[56] References Cited

U.S. PATENT DOCUMENTS

| | | | |
|---|---|---|---|
| 2,633,240 | 3/1953 | Bishop | 209/166 |
| 2,695,101 | 11/1954 | Booth | 209/166 |
| 2,740,522 | 4/1956 | Aimone | 209/166 |
| 3,138,550 | 6/1964 | Woolery | 209/166 |
| 4,113,466 | 9/1978 | Weston | 209/166 |
| 4,222,862 | 9/1980 | Finch | 209/166 |
| 4,253,614 | 3/1981 | McGarry et al. | 209/5 X |
| 4,268,379 | 5/1981 | Poulos et al. | 209/5 |
| 4,340,467 | 7/1982 | Wang | 209/166 |
| 4,450,070 | 5/1984 | Hefner, Jr. | 209/3 |
| 4,466,887 | 8/1984 | Gross | 209/166 |

*Primary Examiner*—Kenneth M. Schor
*Assistant Examiner*—Thomas M. Lithgow
*Attorney, Agent, or Firm*—David A. Jackson; Richard M. Goldberg; Barbara L. Renda

[57] ABSTRACT

The present invention provides a blended preparation for the separation especially of coal particles from the tailings which are contained in the fines produced in coal mining. The blended preparation is used instead of or in addition to the conventional froth oil. The blended preparation comprises froth oil, flocculating agent, emulsifying agent, water and optionally, anti-freeze. The use of the preparation results in faster separation and saving in flocculating agent.

15 Claims, 5 Drawing Sheets

PARTICLE SEPARATION

This invention relates to particle separation, and in particular concerns particle separation by frothing of a liquid phase which contains the particles to be separated.

Typically, the separation will involve the separation of the two types of particle in suspension, one being a hydrophylic particle type, and the other being a hydrophobic type. The invention can apply to the separation of any type of particle which can be separated by this method, although the present invention is mainly concerned with the separation of coal particles from other mineral particles including ash particles, clay, soil and other particles. For simplicity of description herein, all of the particles contained in suspension in the liquid phase will be referred to as "fines" whilst the residual particles after separation of the coal will be referred to as "tailings". It will be appreciated that the fines are made up of the coal particles and tailings. As the respective particles are separated by frothing or flotation, it will be understood that the process involves the separation of relatively small particles, and in the case of coal particles these are normally up to a size of half a millimeter in diameter.

In the older traditional method of mining coal, involving the manual picking of the coal from the coal face followed by shovelling and delivery using mine carts, which yielded a relatively small output from the mine, the amount of fine coal particles produced in the mining operation was relatively small i.e. of the order of 5% of the coal mined. However, with the utilisation of high speed modern coal cutters, and automating the discharge of the coal from the mine at high speed, the volume of fine coal particles produced in any mining operation is considerable i.e. up to as much as 50% of the coal which is mined. Whereas previously the amount of fine coal particles produced during the mining operation was so small as to be virtually ignorable, it is no longer economic to simply throw away the coal particles produced during the mining operation.

Therefore, most modern mines using coal cutters are equipped with a washing and recovery plant for recovering the coal particles, and the plant operates basically as follows.

All of the coal which is discharged from the mine is washed by a plant which re-cycles the washing water or liquor, and coal above half a millimeter in diameter is separated from the fines which contain the coal particles and the various other tailings, and the fines suspended in water are charged as a liquid phase or slurry, of which there are approximately 8–10% solids, into a conditioning tank. In the conditioning tank is an agitator in the form of an impellor which maintains the fines distributed throughout the water, and to this conditioning tank is added what is known as a froth oil in the ratio for example of ½ kilo of froth oil to one ton of dry fines, or approximately ten tons of the liquid phase. The froth oil has two basic ingredients namely an oil known as a collector, which being hydrophobic coats the coal particles, and a frothing agent to cause the liquid phase subsequently to froth as explained hereinafter.

In the conditioning tank, the oil forms a thin film on the coal particles, which are hydrophobic and will therefore more readily take up the oil than the surrounding water, but the oil will not attach to the tailings which are in fact hydrophylic. The liquid phase can be conditioned in this manner in the conditioning tank for as long as is necessary to effect the even dispersion and coating of the coal particles. The liquid phase is then discharged from the conditioning tank into a series of flotation cells each comprising a mechanical agitator in the form of an impellor which is driven at high speed and an air induction pipe leading to the region of the impellor. The liquid phase from the conditioning tank is discharged into the first cell close to the impellor working region so as to be directly engaged and agitated thereby, and at the same time air is drawn into this region through the air induction pipe whereby an agitated and aerated liquid mass is created. This action, in conjunction with the frothing agent, causes the formation of evenly dispersed bubbles which arive as a froth at the head of the liquid phase. These bubbles carry the oil coated coal particles to the surface and into said froth head, whilst the tailings tend to remain in suspension in the liquid phase under the froth head. A wiping paddle or blade deflects the froth head laterally and over an edge of the cell so that the froth head flows down the outside of the cell and drops onto a collecting trough (or launder). The froth when it lands on the collecting launder collapses and forms a liquid containing the coal particles, which liquid flows away taking the coal particles towards a filtering zone. The liquid phase containing the tailings is drawn from the first cell into the second cell, being delivered again in the region of the cell impellor so that the process of the first cell is duplicated, except that there will of course be a lessor concentration of coal particles in the second cell so that less will be separated in the froth head. The process repeats for as many cells, typically 6, as are required in order to separate out as much of the coal particle content as possible in what amounts to a fractionating process. The foam heads which are discharged over the edges of the respective cells fall into the same launder so as to form a continuous stream of liquid containing the coal particles.

The liquid containing the coal particles is treated with a filter aid preparation before the resulting mixture is passed to a vacuum filter drum whereat the liquid is withdrawn, leaving a cake of coal particles on a filtering blanket which passes round the drum, and from this blanket the coal cake is discharged and collected for blending with coal particles or pieces of different sizes.

The liquid phase containing the tailings in suspension is passed to a large settlement tank but before reaching the tank it is mixed with a floculating agent the effect of which is to cause the tailings particles rapidly to separate from or settle in the water of the liquid phase. The water from the settling tank, and also from the filter drum are returned to the washing cycle plant of the colliery.

This process has a number of disadvantages including the following.

1. Despite the attempts made to reclaim only the coal particles, there still remains with the filter cake a measurable proportion of ash particles, which reduces the quality of the filter cake.

2. The method of dispersing the coal and tailings in the conditioning tank does not lead to as efficient a distribution of the froth oil throughout the liquid phase as is possible.

3. The addition of the flocculating agent to achieve the settling out of the tailings, and the addition of the filter aid to improve the filtering of the coal particles is at present done by judgement of an operator which can be wasteful in materials, but more seriously can, if these materials are used in excess, result in a return of these materials in the re-cycled water to earlier stages in the cycle of operations which can lead to difficulties.

It is to be mentioned at this point that coal qualities differ and indeed coals are ranked as high, medium or low ranking depending upon the calorific output of the coals, which is to some extent dependent upon the amount of tailings therein, the higher the calorific output, the higher the ranking.

It is the case that the known flotation separation process in fact varies in its efficiency depending upon the ranking of the coal being processed.

The present invention is concerned with overcoming or reducing these aforesaid difficulties with the known method and in accordance with the general aspect thereof, there is provided a blended preparation for use in a flotation separation processes, such as the separation of coal particles, wherein the ingredients of a froth oil are blended with an emulsifying agent, a flocculant and water, blended to create a preparation in which the oil of the froth oil is dispersed in droplets in the preparation.

By providing a blend such as this, it can be used directly at the beginning of a flotation separation cycle, such as in the conditioning tank in the coal separation process described above, or it can be added in the first or a subsequent flotation cell, or it can be added at several of these cells.

The main advantage of the invention is achieved however if, especially in the case of coal particles separation, the emulsion blend is added to a conditioning tank, because the oil droplets in the blend in being dispersed therein will provide a large number of globules for contacting the coal particles, and therefore the degree of contact between coal particles and oil droplets will be greater than in the known method, and many more of the coal particles will be coated quicker by using an emulsion in which the oil is finally dispersed.

The blend may comprise the ingredients of conventional froth oil with the addition of the emulsifying agent, water and the flocculating agent.

The flocculating agent is included for several reasons. The first reason is in fact to condition the liquid phase in the flotation cells so that the tailings will tend constantly to separate from the water of the liquid phase as soon as allowed to do so, without the flocculating agent or so much of said agent having to be added at the end of the separation cell process, but secondly the flocculation agent has a synergystic effect on the blend in that it keeps the oil particles in suspension in the blend for a long period. This is important, because the blended material must be capable of having a long shelf life so that it can be used at will, but without the oil droplets separating out of suspension.

The invention also provides a method of separating particles, especially coal particles from tailings. Using the blend material as aforesaid.

Whilst the types of emulsifier and flocculating agent can vary depending upon the particles, and indeed depending on the ratings of coal particles to be separated, it is preferred that the ingredients of the blend be of the following proportions.

The froth oil collector and frothing ingredients may be in the proportions to each other as are conventionally used e.g. typically 85%–15%, but the water, flocculating agent and emulsifying agent preferably comprise, of the total volume including the froth oil ingredient, the following percentages by volume.

1. Water—10%–40%
2. Emulsifying Agent—0.1%–1%
3. Flocculating Agent—0.1%–1%

Preferably the blended preparation may include an anti-freeze preparation, in order further to prohibit the separation out of the phases when the preparation stands in a cold environment. The anti-freeze preparation may comprise 1–5% by weight of the total blended preparation and displaces an equivalent amount of the water.

The blending of the ingredients to produce the blend may be effected in a high viscosity mixer, and effective emulsification of the oil may be achieved by running the blender for of the order of several minutes.

The use of the blend according to the invention produces a number of surprising and advantageous results. Thus, because the blend has the oil in droplets in suspension therein, when it is introduced into the liquid phase in the coal particle separation process in the conditioning tank, the oil droplets by their pre-dispersion, are immediately available for contact with the coal particles in the conditioning tank, and there is more effective and quicker coating of the coal particles with the oil leading to more rapid separation and a more rapid recovery of the coal particles.

Secondly, the presence of the flocculating agent conditions the liquid phase so that the tailings contained therein are always tending to separate out rapidly, and therefore as soon as the liquid phase containing the tailings is discharge from the last flotation cell, the tailings immediately start to separate from the water in an efficient manner, and additional flocculating agent may not need to be added at this stage. The process is therefore quicker, and as the amount of flocculating agent can be calculated accurately in the blending of the blend according to the invention, it can be arranged that there is no excess flocculating agent at the end of the flotation cell process, and therefore there will be no danger of any excess flocculating agent being returned to the beginning of the cycle. Excess flocculating agent returned to the beginning of the cycle can result in the collapse of the froth of the foam heads in the flotation cells. Furthermore, tests on separation of lower ranking coal have shown that use of the preparation according to the invention results in a filter cake having less ash content.

Also, because the froth oil is combined with other ingredients including water, less froth oil is used which represents a financial saving.

The following description given by way of example and with reference to the accompanying diagrammatic drawings is in order to assist in explaining the basic principles of the present invention, and the drawings show a flow chart indicating the processing of mined coal with particular reference to the separation of the coal particles of a size ½ mm or less from the tailings.

Figure 1:
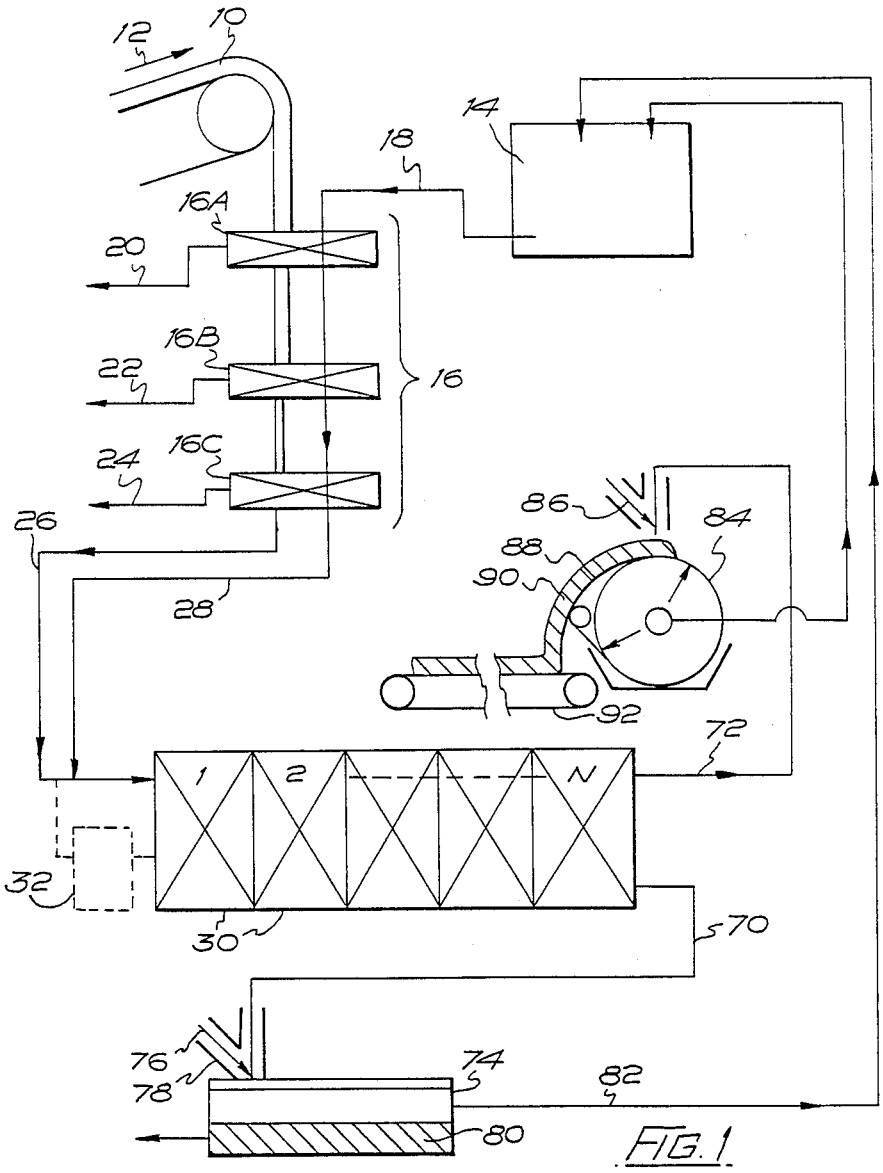
FIG. 1 is a diagrammatic view showing the processing of coal which arrives from the run of a coal mine.

Referring to FIG. 1, a typical lay-out of the processing plant of a coal mine is illustrated in diagrammatic form. The mined coal is shown arriving from the coal mine by reference numeral 10, the coal travelling as indicated by arrow 12. Reference numeral 14 represents the washing water tank containing water which is used in the processing of the coal 10, and the raw mined coal enters a series of jigs and screens 16 with the water supply indicated by supply line 18. The water is for washing the coal and is also for carrying small coal particles which will be contained in the coal supply 10. Also contained in the coal supply will be ash and other particles of other minerals, mud, clay and the like which pass through the screens and jigs 16.

The jigs and screens are for filtering of coal lumps and pieces of particular sizes, and for example the jig 16A may filter off coal pieces and lumps in the size range 2 to 6 inches as indicated by numeral 20, it being noted that there will not be any coal lumps greater than 6 inches in the supply 10. The filter 16B may take off coal pieces in the range 1/2 inch to two inches as indicated by line 22, whilst filter 16C may remove as indicated by line 24, coal granules in the size range ½ mm to ½ inch. The residual coal particles and tailings particles of a size less than ½ mm travel as indicated by line 26 along with the water as indicated by line 28, but in the form of a mixed slurry, to the flotation tanks 30, or through a conditioning tank 32 before travelling to the flotation tanks or cells 30.

There is added to the slurry 26/28, a frothing oil, and this may be added in the conditioning tank and/or in one or more of the flotation cells 30. Such a frothing oil comprises a frothing agent designed to give bubbles resulting in a froth of suitable stability and strength as will be understood when the operation of the flotation cells is described, and a collector which is in fact made up of two collector agents. One being an aliphatic collector, and the other an aromatic collector. The purpose of the collector is to provide a hydrophobic medium which will attach to the coal particles in the slurry, as these are also hydrophobic in nature; the tailings, being hydrophylic, are not coated with the collector material. When the mixture of slurry and frothing oil are subjected to agitation and air is introduced, the bubbles which are created in the mixture float to the surface and take with them the coal particles coated with the collector, as the collector adheres to the bubbles.

The conditioning tank 32, if used, will comprise simply a large vessel into which the slurry is charged, and into which the frothing oil is added. The conditioning tank contains a large driven impellor which effects homogenising of the slurry and frothing oil to effect the application of the coating element of frothing oil to the coal particles. No bubble phase is created in this tank. The resulting liquid mixture is added to the flotation cells 30 in turn. It is to be appreciated that as many flotation cells as required can be used, but they are used in sequence, hence the numbering 1, 2 . . . N. and. as will be explained. the material discharged from the first flotation cell is passed to the second flotation cell for further treatment, and then to the third cell and so on until the end cell from which the material is discharged for further processing, and sequentially coal particles are removed from the respective cells as will be explained.

Figure 2:
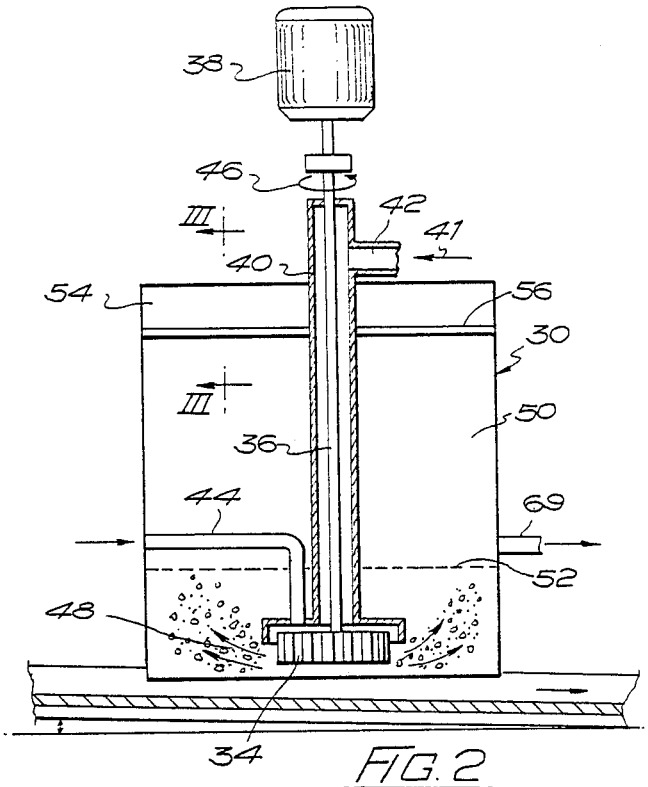
FIG. 2 is a sectional elevation through one of the floation cells shown in FIG. 1.
Figure 3:
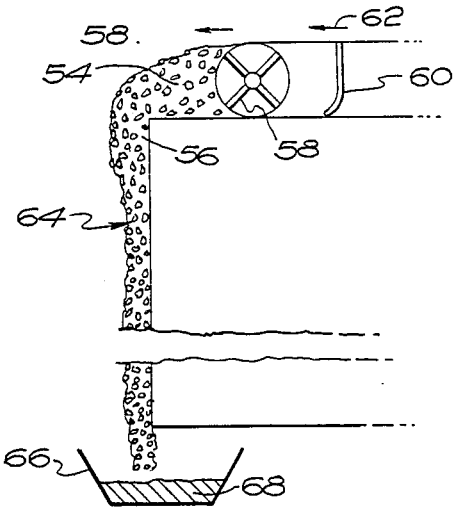
FIG. 3 is a sectional elevation taken on the line III—III in FIG. 2.

If reference is now made to FIG. 2. one of the cells 30 is shown, and it will be seen to comprise a tank in which is contained at the base thereof a high-speed impellor 34 driven by a shaft 36 and a motor 38. Surrounding the impellor is an air induction tube 40 with an air inlet 42 at the top thereof. The incoming mixture of slurry and frothing oil is charged into the tank at a position above the impellor 34 so as to come directly under the influence thereof. As the impellor is driven at high speed as indicated by arrow 46, air is induced through tube 40 as indicated by arrow 41 and arrives in the vicinity of the impellor concurrently with the arrival of the slurry/-froth oil mixture, which can be considered the liquid phase of a cell. The liquid and air bubbles are ejected from the sides of the impellor as indicated by the arrows 48, and the bubbles travel up through the liquid 50 in the cell, a baffle 52 serving to retain some solid particles of the tailings, and the bubbles take with them coal particles so that there is in fact formed a head or froth 54 on the top of the body of liquid 50. At one side, the cell 30 is provided with a weir 56, as best seen in FIG. 3, and the liquid level of the body of liquid is controlled so that the froth head 54 lies above the edge of weir 56. A scraping mechanism such as the scraper wheel 58 or, in the alternative, a scraper blade 60 is used to sweep the foam 54 as indicated by arrow 62 over the weir 56 so that in fact the foam trickles down the outside of the tank 30 as indicated at 64, and falls into a launder 66 which is inclined slightly as shown in FIG. 3. The foam is such that when it strikes the launder 66 it collapses to a liquid 68 which flows down the launder 66 to a collection zone as will be explained.

The liquid 50 in the cell 30 retains the tailings, and passes out of the cell as indicated by the outlet pipe 69, to the next cell or to a processing station as appropriate. Some of the larger solid tailing particles will be retained by the screen 52 in the base of the cell.

Returning now to FIG. 1. the outlet from the end cell for the body of liquid 50 in that cell is indicated by the outlet line 70, whilst reference 72 indicates an outlet line of the launder 66, and which carries the liquor containing the coal particles.

The body of water containing the tailings which is passed through line 70 is led to a settlement tank 74, but before entering this tank, the liquid is treated with a flocculating or thickening agent applied as indicated by arrow 76 through a lateral connection pipe 78. The use of this thickening or flocculating agent ensures the rapid settlement of the tailings as shown by reference 80 in the base of the settlement tank, whilst the clear liquid, which should be of water or mainly of water is taken by the line 82 back to the storage tank 14 of the water circuit.

The liquor carrying the coal particles through pipe 72 is led to a vacuum drum filter 84 but is mixed with a filter aid applied as indicated by arrow 86 before being applied to the drum 84. The filter aid is a liquid treatment medium and assists in the separation of the liquor and the coal particles, and the vacuum draws the liquor which should essentially be water through the filtering drum 84 and a blanket 88 thereon, leaving a filter cake 90 of coal particles on the blanket. This cake is deposited for example on a discharge conveyor 92, and the cake, which comprises totally or mainly coal particles of a size of ½mm or less is transported to another location, for example a blending location whereat the cake is mixed with coal of larger size particles or pieces to provide a blend for the customer.

The above comprises the conventional method of processing mined coal for the recovery of the particles under ½mm size, and whilst the process works satisfactorily, it is believed that it does not work as efficiently as it might for the reasons explained hereinbefore and insofar as at least in the lower ranking coals the ash retained in the cake 90 can be prohibitively high, and also with the lower ranking coals the amount of coal particles which escape through the line 70 can be prohibitively high.

The present invention seeks to provide a preparation which will achieve improvements compared with the present prior art method. The present invention resides in the production of a preparation which is a blend to use in place of the conventional neat frothing oil. The blend comprises a frother, which may be conventional, and the collectors which also may be conventional, but the blend also includes flocculant, water and emulsifier.

The blend will be especially formulated to take into account the coal size distribution and also the coal ranking i.e. whether it is bituminous, lignite etc., the local water type and the number of flotation cells used at the colliery.

It is preferred that the blend used be introduced with the slurry into a conditioning tank such as tank 32. The use of an emulsion and a flocculating agent at this stage achieves a number of considerable advantages.

Firstly, by using an emulsion in the blend, and by agitating the blend sufficiently, using a high viscosity blender, to achieve homogenising of the blend, the oil of the frothing oil is finely dispersed throughout the blend in droplets and the oil droplets will remain in suspension for a long period and therefore the blend can be stored until it is ready for use. The fine dispersion of the oil droplets ensures that when the blend is mixed with the slurry, there will be an immediate and efficient coating of the coal particles with the collector.

The presence of the flocculant ensures that in the flotation cells, the flocculant will be trying to agglomerate together the tailings particles, and although because of the agitation in the flotation cells the tailings will continue to be in suspension, as soon as the body of liquid leaves the last flotation cell, the tailings will immediately start to settle out, and the use of a flocculating agent for example at location of pipe 78 may not be necessary and certainly the amount of flocculating agent which is used can be reduced. Thereby, the quality of the returning water through pipe 82 can be improved.

Because there is more rapid and more efficient coating of the coal particles by placing the frothing oil droplets in suspension, a quicker coal yield is achieved from the flotation cells, and tests have shown that with lower ranking coals at least a purer filter cake 90 is obtained.

It will be appreciated that the relative proportions of froth oil (frother; collector), water, emulsifying agent, and flocculant within the blended preparation can be varied, but the following are typical ranges on a volume basis for these respective ingredients.

Frothing agent: 5–20%;
Collector: 60–80%;
Water: 10–40%;
Flocculating agent: 0.1–1%;
Emulsifying agent: 0.1–1%; and
Where provided—anti-freeze 1–5% by weight of total preparation.

Typical frothers which may be used for the blend according to the invention are as follows:

short chain alkanols, short chain glycols, ethoxylated alcohols, mixed alkylene oxide, glycol ethers, propoxylated alcohols, polypropylene glycols.

Typical collectors which may be used for the blend are as follows:

aliphatic hydrocarbons, such as Kerosene, Diesel oil, aromatic hydrocarbons, such as mixed ester/alcohol heavy ends.

Typical flocculating agents which may be used for the blend are as follows:

polyacrylsmides type of either anionic, cationic, or nonionic nature of varying molecular weights;

Typical emulsifiers which may be used for the invention are as follows:

Any traditionally used emulsifier blends for hydrocarbon oils and typically the following;

mixtures of nonyl phenol ethoxylates where the number of ethoxylate groups can vary in the range 4 to 14, similarly detergent alcohol ethoxylates typically $C_{10}$–$C_{15}$ alcohols; mixed nonionic and anionic detergents.

Anti-freeze preparations which can be used are as follows:

A solution of ures (carbamide) a neutral amide in the aqueous phase incorporated into the blend at a concentration of 1–5% by weight of ures in the final preparation.

The amount of the blend according to the invention which is used in any particular application will to some extent depend upon the concentration of coal particles, the type of coal and so on, but a number of test examples are now given herein.

EXAMPLE

A lab test was carried out in relation to slurry samples received from Dentinck Colliery in England, and this test was to compare the separation results using on the one hand a conventional froth oil, and on the other hand using an emulsified froth oil preparation in accordance with an embodiment of the invention.

Of the slurry received from the colliery, this is first of all dewatered, and the solid residue is water analysed in order to give a figure of dry solids content. The sample of the dry solids content is subjected to ash analysis in order to give the ash content of the dry solids. This figure provides an indication of the quantity of coal available in the sample.

The solids residue is again mixed with the separated water liquor and additional liquor from the Colliery is, added to generate a slurry of the pulp density of 1.0% solids. The slurry is then separated so as to provide samples for the two sets of tests. In the first test, 240 mls of the slurry is mixed with 0.3 ml of a froth oil comprising 70% Kerosene, 20% aromatic hydrocarbon, and 10% frother, the frother being mono methyl ester of propylene glycol.

The resulting mixture is conditioned in a Denver test rig tank for 1 minute by rotating the impellor therein at 1500 rpm. Subsequently, air is introduced in order to create the froth phase, and the froth is removed from the top of the test cell continuously until the froth becomes visibly barren i.e. it contains no coal. This phase of the test usually lasts between 4 and 8 minutes, the impellor again being rotated at 1500 rpm. The froth containing the coal particles and the residual liquor containing the tailings are subjected to filtering and drying, and then the dried coal particle residue, referred to as the "float" is subjected to ash analysis as is the dried tailings.

This test method was repeated, but instead of using 0.3 ml of neat froth oil, 0.3 ml of a blend comprising 75% of the said froth oil and 25% of a 1% solution of a flocculent in water together with 2.000 parts per million of an emulsifier on the basis of the whole was used in place of the neat froth oil. The emulsifier comprised equal parts of nonyl phenol 4-ethoxylate and nonyl phenol 9-ethoxylate. The flocculant comprised the proprietory flocculant known as Magna Floc 156 supplied by Allied Colloid. No anti-freeze was included. The emulsifier and flocculant were added to the water content of the preparation prior to adding the water to the froth oil, and mixing and dispersing was effected by hand agitation.

The above test was repeated on a further sample or samples of the 10% pulp density slurry and the accompanying table indicates the average results and compares the use of neat froth oil and the blend according to the embodiment of the invention. It can be seen that in using the blend of the present invention, 4% more coal particles are yielded in the float.

| | Total Weight (gms) | | % Ash | | Coal in |
|---|---|---|---|---|---|
| | Float | Tailings | Float | Tailings | Float |
| TEST 1 Froth Oil Only | 137.7 | 11913 | 23.93 | 75.45 | 78% |
| TEST 2 Froth Oil Emulsion Blend | 143.4 | 112.4 | 18.38 | 85.00 | 82% |

EXAMPLE 2

Figure 4:
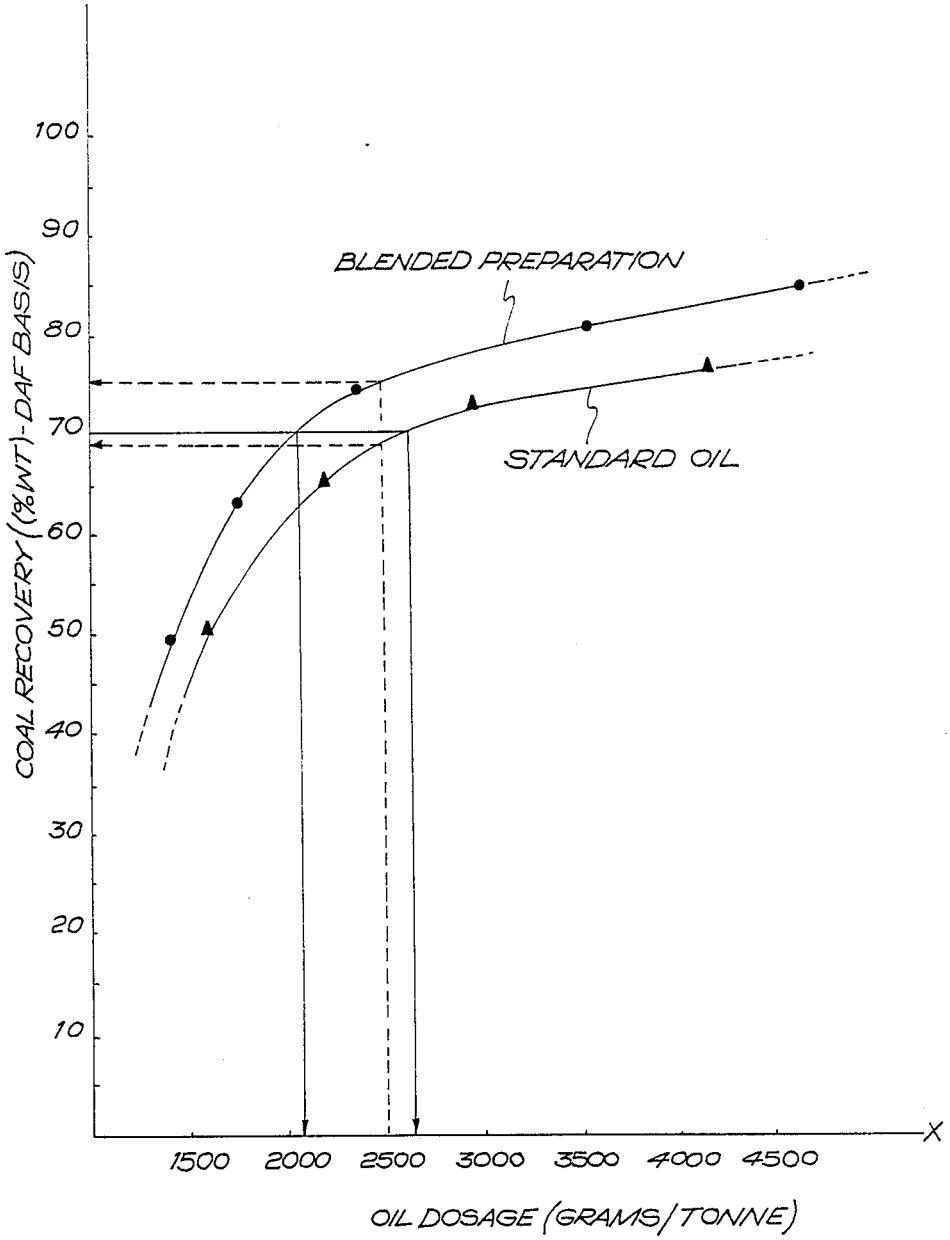
FIGS. 4, 5 and 6 are graphs showing actual test results for comparison using a standard froth oil on the one hand and a blended preparation according to the invention on the other hand.
Figure 5:
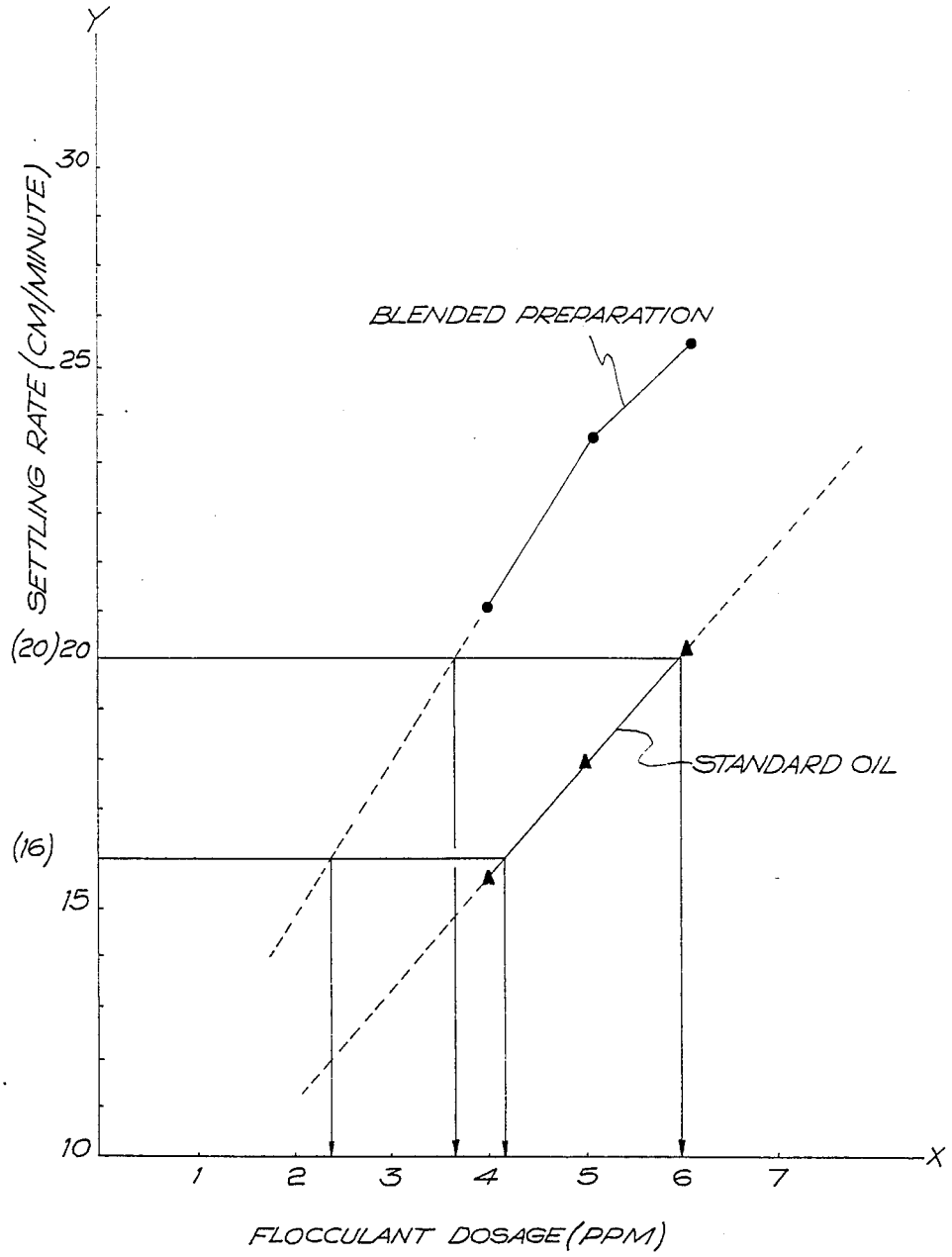
Figure 6:
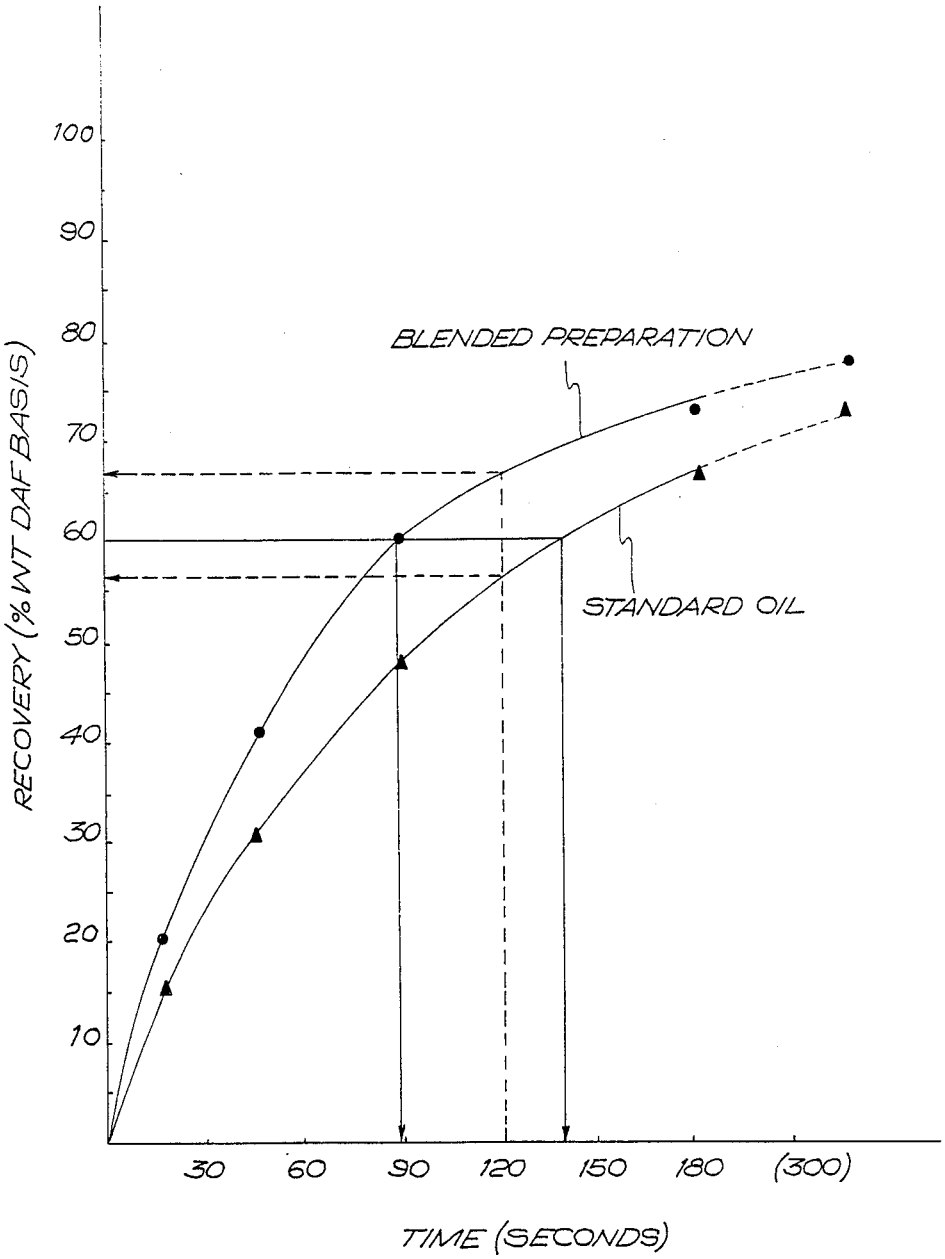

An extensive series of compatability tests were carried out on Rawdon coal, which is a low ranked coal, and the results are summarized in graphic form in FIGS. 4, 5 and 6.

For these tests, which were laboratory floatation tests, a standard froth oil performance was compared to the blended preparation according to the invention.

The froth oil used was of the following composition: by weight:

75% W/W: Aliphatic Hydrocarbon—Collector
15% W/W: Aromatic Hydrocarbon—Collector
10% W/W: Polypropylene Glycol Ether—Frother The blended preparation according to the invention was of the following composition by weight:

75% W/W: STD Froth Oil
0.1% W/W Nonyl Phenol 4 Mole Ethoxylate
0.1% W/W: Nonyl Phenol 9 Mole Ethoxylate
0.1% W/W Nonyl Phenol 9 Mole Ethoxylate (Co-Emulsifier Blend)
0.25% W/W Polyacrylamide Flocculent
3.75% W/W Low Temperature Stability Agent
Blanace to 100% W/W with Water All materials blended by high viscosity mixer.

In the graph of FIG. 4, the amount of coal recovered versus oil/preparation dosage is recorded and it will be seen that over the range of dosages, higher coal yields are obtained using the blended preparation, and of the two examples indicated on the graph, it is seen that to obtain a 70% coal recovery requires 2.600 grammes of standard froth oil/tonne of fines, whilst only 2050 grammes of blended preparation are required to give the same yield, whilst alternatively the use of 2.500 grammes of standard froth oil per tonne of fines yields 69% recovery of coal particles and the use of 2.500 grammes of blended preparation yields 75% coal particle recovery, clearly indicating that use of the blended preparation represents an economic use of the froth oil or a higher yield of coal particles.

The graph of FIG. 5 shows the settling rate of the tailings against flocculant dosages and it can be seen that using the blended preparation, a much higher settling rate for the tailings is achieved.

The graph of FIG. 6 shows the coal recovery against time, and it can be seen that, again with the blended preparation, the coal recovered in any given time period is higher using the blended preparation as compared to the standard oil.

It is useful to indicate the considerable advantages to be achieved by the preparation of the present invention and the utilisation of same in coal particle recovery.

These advantages include the following:

1. More rapid separation of coal particles from ash minerals producing a more rapid process.
2. In some cases at least (low ranking coals) enhanced coal content in the filter cake.
3. Increased rate of flotation due to disperation of oil droplets.
4. Lower dosage of froth oil required.
5. The pre-conditioning of the tailing stream using the flocculating agent speeds thickening and settling of tailings and less flocculating agent is required.

In the conventional process, the filtering aids and flocculating agents can have a detrimental effect by building up in the return wash water, but by using the blend of the invention which embodies an emulsified froth oil in water combined with a flocculating agent, and, if appropriate, a filter aid, shows that the detrimental effect of flocculating agent and filter aid build up is negated and the increased dispersion of the oil droplets produces a more efficient froth flotation separation of the coal from gangue in the cell.

If the tailings do require treatment after leaving the flotation cells, such treatment will require only the use of reduced dosage of thickening agent or flocculant.

Use of particular emulsifying agents in conjunction with a flocculating agent/filter aid of the type hereinbefore described, stabilises the emulsion, and there is a reduced conditioning time. The use of an emulsifier in fact negates the normally detrimental effect of the presence of a flocculating agent in the flotation process.

We claim:

1. A prepared blended preparation for use in froth floatation separation of coal particles, from non-coal particles, said preparation; ingredients comprising a froth oil blended with an oil-in-water emulsifying agent, a non-coal particle flocculating agent and water, said prepared blended preparation is blended to create a preparation in which the oil of the froth oil is dispersed in droplets in the preparation, said prepared preparation does not contain any of said coal or non-coal particles.

2. A blended preparation according to claim 1, wherein the froth oil comprises collector and frothing ingredients in the proportion to one another of 85% to 15%.

3. A blended preparation according to claim 1 or 2, wherein the emulsifying agent and flocculating agent are included in the preparation based upon the total volume of the preparation, in the following percentages by volume:

Water: 10%–45%

Emulsifying agent: 0.1%–1%

Flocculating agent: 0.1%–1%

4. A blended preparation according to claim 3, further comprising an anti-freeze agent.

5. A blended preparation according to claim 4, wherein the anti-freeze agent is included, based upon the total weight of the preparation in an amount equal to 1–5% by weight.

6. A blended preparation according to claim 5 wherein the anti-freeze agent is any one or mixture of the following:

a solution of urea, also known as carbamide, in the aqueous phase incorporating in the blend at a concentration of 1–5% by weight of urea in the final total preparation.

7. A blended preparation according to claim 1 wherein the blended preparation is emulsified by being blended with a high viscosity mixer.

8. A blended preparation according to claim 7, wherein the blended preparation is emulsified by the high viscosity mixer for at least one minute.

9. A blended preparation according to claim 2 wherein the frother is one or a mixture of the following:

short chain alkanols, short chain glycols, ethoxylated alcohols, mixed alkylene oxide, glycol ethers, propoxylated alcohols, polypropylene glycols.

10. A blended preparation according to claim 2, wherein the collector is any one or mixture of the following:

aliphatic hydrocarbons, Kerosene, Diesel oil, aromatic hydrocarbons, mixed ester/alcohol heavy ends.

11. A blended preparation according to claim 1, wherein the flocculating agent is any one or mixture of the following:

polyacrylamides type of either anionic, cationic, or nonionic nature of varying molecular weights.

12. A blended preparation according to claim 1 wherein the emulsifier is any one or mixture of the following:

mixtures of nonyl phenol ethoxylates where the number of ethoxylate groups can vary in the range 4 to 14, similarly detergent alcohol ethoxylates typically $C_{10}$–$C_{15}$ alcohols; mixed nonionic and anionic detergents.

13. A method of separating coal particles from non-coal particles by a froth flotation process said method comprises bring said coal and non-coal particles into contact with a preprepared blended preparation said prepared blended preparation ingredients comprising a froth oil blended with an oil-in-water emulsifying agent, a non coal particle flocculating agent and water said preparation is blended to create a preparation in which the oil of the froth oil is dispersed in droplets in the preparation prior to bringing said coal and non-coal particles into contact with said preparation.

14. A method according to claim 13, wherein the coal and non-coal particles and the preparation are brought into contact in a conditioning tank before being passed to floatation cells wherein the coal and non-coal particles are separated by a conventional floatation process.

15. A method according to claim 13 or 14, wherein the coal particles are produced in coal mines and contained in coal fines.

* * * * *

UNITED STATES PATENT AND TRADEMARK OFFICE

CERTIFICATE OF CORRECTION

PATENT NO. : 4,756,823

DATED : JULY 12, 1988

INVENTOR(S) : DEREK O'NEILL ET AL.

It is certified that error appears in the above-identified patent and that said Letters Patent is hereby corrected as shown below:

ON THE FACE OF THE PATENT, ITEM [73], PLEASE CORRECT THE NAME OF THE ASSIGNEE TO READ:

-- CARGO FLEET CHEMICAL CO., LTD. --.

Signed and Sealed this

Twelfth Day of November, 1991

*Attest:*

HARRY F. MANBECK, JR.

*Attesting Officer*

*Commissioner of Patents and Trademarks*